US005828344A

United States Patent [19]

Alder et al.

[11] Patent Number: 5,828,344

[45] Date of Patent: Oct. 27, 1998

[54] RADIATION SENSOR

[75] Inventors: Christopher J. Alder; Paul M. Backhouse; Huw D. Rees, all of Worcs, England

[73] Assignee: The Secretary of State for Defence in Her Britannic Majesty's Government of the United Kingdom of Great Britain and Northern Ireland, London, United Kingdom

[21] Appl. No.: 744,781

[22] Filed: Jul. 23, 1991

[30] Foreign Application Priority Data

Aug. 1, 1990 [GB] United Kingdom ..... 9016854

[51] Int. Cl.[6] ..... H01Q 19/10

[52] U.S. Cl. ..... 343/755; 343/756; 343/909

[58] Field of Search ..... 343/753, 754, 343/755, 756, 909; 359/122; 250/225; 356/369

[56] References Cited

U.S. PATENT DOCUMENTS 3,763,493 10/1973 Shimada et al. ..... 343/755

4,604,624 8/1986 Amitay et al. ..... 343/756

5,089,828 2/1992 Moss ..... 343/909

*Primary Examiner*—Theodore M. Blum

*Attorney, Agent, or Firm*—Nixon & Vanderhye P.C.

[57] ABSTRACT

A radiation sensor for the microwave and millimeter-wave regions incorporates a lens having two parallel focal planes, these being defined by a polarization-selective reflector grid within the lens. One focal plane is occupied by a receive array of crossed dipole antennas with respective mixer diodes. One dipole of each antenna couples to a local oscillator signal and the other couples to a receive signal reflected by the grid. These signals are mixed by the diodes to produce intermediate frequency signals for subsequent processing. The other focal plane is occupied by a transmit array of separately activatable polarization switching antennas arranged to define a range of transmit beam directions. This focal plane may alternatively be occupied by a second receive array.

20 Claims, 6 Drawing Sheets

RADIATION SENSOR

BACKGROUND OF THE INVENTION

1 . Field of the Invention

This invention relates to a radiation sensor, and more particularly but not exclusively such a device for use in radar or communications systems at frequencies in the microwave and millimeter-wave regions of 10 GHz and above.

2 . Discussion of the Prior Art

Radiation sensors are well known in the prior art. U.S. Pat. Nos. 4,331,957 describes a dipolar antenna employed in a radar transponder device and used for location of avalanche victims and the like. It is a substantially omnidirectional device, this being a property of dipolar antennas, and consequently does not provide directional scene information. It cannot be used to identify target bearings, and is a short range device (eg 15 meters).

Many radiation sensors are employed as radars, which may be required to provide directional scene information at ranges in the order of kilometers or more. This requires scanning with a directional antenna device such as those employed in the missile seeker field. U.S. Pat. No. 4,199,762 describes a support for a radar antenna, the support being mechanically scanned about two orthogonal axes by virtue of a gimbaled mounting. Such a device is comparatively bulky and expensive. Moreover, a mechanically scanned antenna is sensitive only to objects within the antenna beam. Fast moving objects passing through the scanned volume need not necessarily encounter the antenna beam.

To overcome the deficiencies of mechanically scanned radars, electronically scanned devices have been developed. Such a device incorporates an array of emitting and/or receiving antennas. The transmit or receive beam direction is controlled by appropriate phasing of the drive signal or local oscillator signal at each antenna. A phased array radar referred to as "MESAR" was disclosed at a conference entitled RADAR-87, London, United Kingdom, 19–21 Oct. 1987. MESAR consisted of an array of nine hundred and eighteen waveguide radiating elements arranged in a square of side 2 meters. A viable phased array with four faces and fifteen hundred elements per face would cost in the order of 2M. Antenna arrays based on dipoles engulfed (ie encapsulated) in dielectric materials are disclosed in U.S. Pat. No. 3,781,896. This disclosure is however silent regarding the formidable design problems involved in feeding signals to and from such an array. It is also silent as regards achieving the required directional properties and measurements.

A further form of radiation sensor is disclosed by Zah et al in the International Journal of Infrared and Millimeter Waves, Vol. 6, No. 10, 1985. It consists of a one-dimensional array of bow tie antennas with integrated diodes arranged in the image plane of a lens system comprising an objective lens and a substrate lens. The signal received by the antennas may be plotted as a function of antenna position to provide an image. This device has the drawback that it is limited to reception mode operation. Moreover, it only detects radiation having a component polarized parallel to the antennas. There is no transmission capability, nor any provision for detection of other polarizations. A frequent requirement of radar sensors is that they provide for transmission and reception through a single aperture.

SUMMARY OF THE INVENTION

It is an object of the invention to provide an alternative form of radiation sensor.

The present invention provides a radiation sensor including a converging dielectric lens arranged to define an optical aperture and an optical axis through the aperture, and wherein:

(a) the lens incorporates polarization-selective reflecting means arranged to define first and second focal planes at respective lens surface regions extending across the optical axis, (b) the reflecting means provides for the focal planes to correspond to differing radiation polarizations, (c) a receive array of antennas is located in the vicinity of the first focal plane, each antenna defining a respective radiation beam direction through the lens and being coupled predominantly to radiation passing through the lens, and (d) in the vicinity of the second focal plane there is either:

(i) directionally selective transmitting means couplable to a plurality of output beam directions through the lens, or (ii) a second receive array of antennas arranged equivalently to the first focal plane array to respond to a different radiation polarization.

For the purposes of this specification, the expression "in the vicinity of" shall be construed to mean "within one wavelength of the sensor operating frequency", the wavelength being that within the medium immediately adjacent the antennas or transmitting means as appropriate.

The invention provides the advantage that it has multiple radiation function capability from a single aperture, and is no less compact than a prior art device having a single function.

The reflecting means may be a grid of linear conductors arranged to reflect one signal polarization and to transmit another, the grid being parallel to both focal planes. The grid may be sandwiched between planar faces of respective lens portions. One lens portion may be shaped as a spherical cap and a second lens portion may be frusto-conical. This provides a very compact form of construction realizable with comparatively low density inexpensive materials.

In a preferred embodiment, the first focal plane array is two dimensional and comprises crossed dipole antennas. One dipole of each antenna is parallel to the polarization of receive radiation incident on it from the reflecting means. In this embodiment, the sensor incorporates a signal generator arranged to supply to the first focal plane array a local oscillator signal polarized parallel to each antenna's second dipole. One of the dipoles may include a divided limb acting as an intermediate frequency transmission line.

The sensor may include a second focal plane receive array of like construction to that at the first. It may also include transmitting means arranged externally of the lens aperture to provide microwave or millimeter-wave illumination of a scene.

In an alternative embodiment, the sensor includes second focal plane transmitting means comprising an array of separately activatable polarization-switching antennas, a linearly polarized radar signal feed to these antennas, and polarization-selective reflecting means arranged to isolate the signal feed from output through the lens and to transmit to the lens signals developed in any one of these antennas in response to the signal feed. This arrangement provides for steering of a transmit beam in any one of a plurality of directions as selected by activation of a corresponding antenna. The polarization-switching antennas may be crossed dipoles incorporating diode switches, and may be formed as slots in a metal layer or sheet.

The sensor may include an alternative form of transmitting means, this form comprising a signal feed which is movable across the second focal plane.

BRIEF DESCRIPTION OF THE DRAWINGS

In order that the invention might be more fully understood, embodiments thereof will now be described, with reference to the accompanying drawings, in which.

DETAILED DISCUSSION OF PREFERRED EMBODIMENTS

Figure 1:
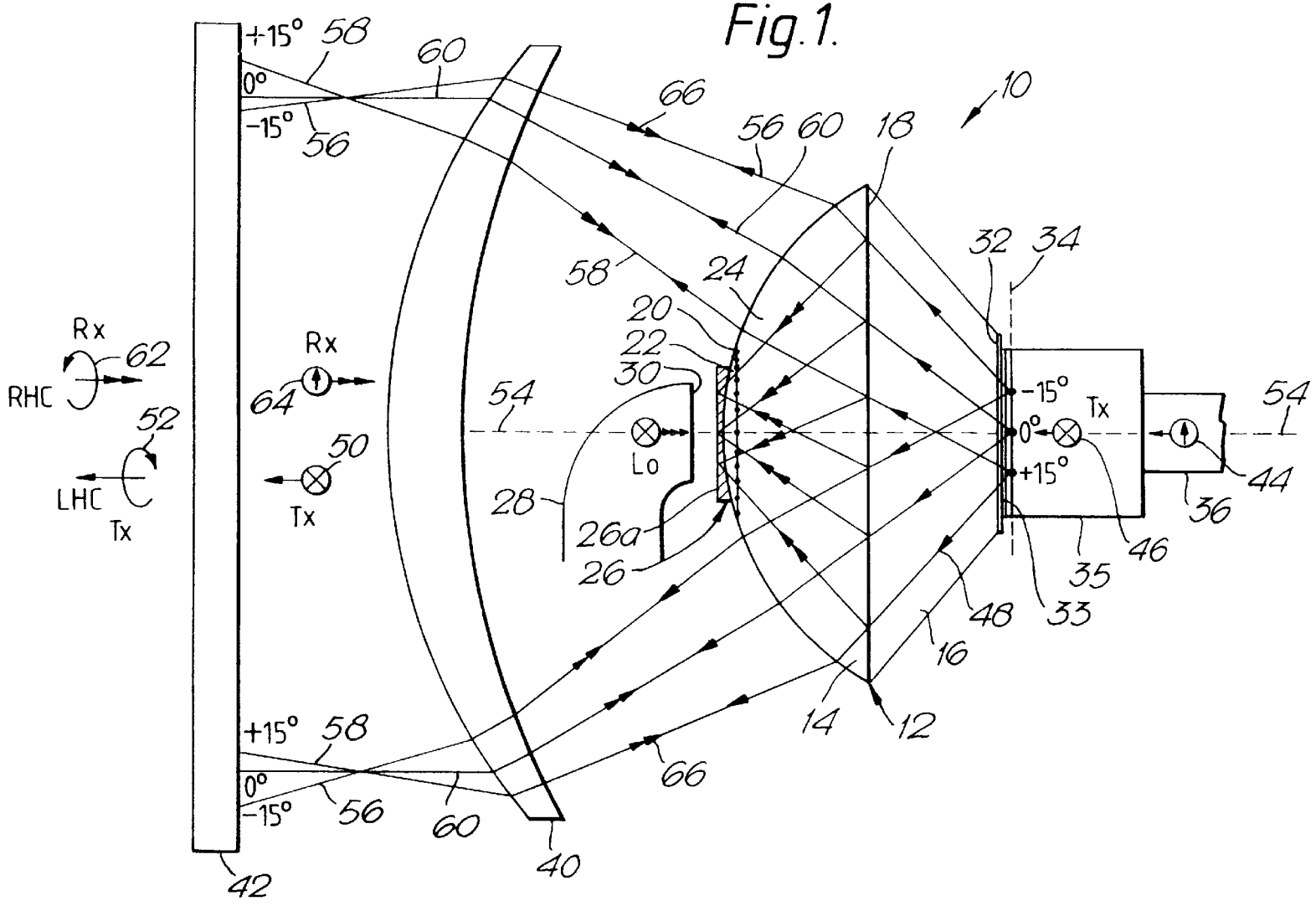
FIG. 1 is a schematic sectional side view of a radiation sensor of the invention.

Referring to FIG. 1, there is shown a radiation sensor of the invention, this being indicated generally by 10. The sensor 10 is designed for operation at a microwave frequency of 16 GHz. It incorporates a lens 12 having a spherical cap portion 14 and a frusto-conical portion 16, these portions having circular end faces (not shown) of equal size adjacent one another. The lens portions 14 and 16 are of alumina, having a dielectric constant of 10. The adjacent end faces are 6.6 cm in diameter, and the spherical cap height or maximum thickness perpendicular to its circular face is 1.9 cm. A metal grid 18 consisting of a planar array of equispaced linear conductors is sandwiched between the adjacent faces of the lens portions 14 and 16. The grid 18 is seen side-on in the drawing, to which its plane is perpendicular.

The spherical cap 14 incorporates a second metal grid 20 in the form of a planar array of linear conductors seen end-on in the drawing. The second grid 20 is sandwiched between first and second divisions 22 and 24 of the cap 14, and its plane is parallel to the first grid 18.

A planar sheet substrate 26 of alumina material is attached to the front central region of the lens 12, the plane of the substrate 26 being parallel to those of the grids 18 and 20. As will be described later in more detail, the substrate 26 bears an array of receive antennas (not shown) each in the form of a pair of mutually orthogonal crossed dipoles. Each dipole is 0.4 cm in length, as appropriate for resonance at 16 GHz at an alumina/air interface. The antennas are located on the outer surface 26*a* of the substrate 26 remote from the lens 12.

A microwave feed waveguide 28 connected to a microwave signal source (not shown) has an open output end 30 close to the substrate 26.

The frusto-conical portion lens portion 16 has a second circular end face at 32 distant 1.678 cm from its first circular surface adjacent the first grid 18; ie the lens portion 16 is 1.678 cm in axial length. The second end face 32 is adjacent to an assembly indicated generally by 33 and incorporating a third grid, a transmit antenna array, an alumina substrate and spacers therefore (not shown). The components of the assembly 33 will be described later in more detail. The thickness of the assembly 33 locates the transmit antenna array in a plane 34 distant 0.222 cm from the second lens end face 32, this being 1.9 cm from the first grid 18 separating the lens portions 14 and 16. The assembly 33 is composed largely of alumina, and its thickness is one quarter of a wavelength of radiation at 16 GHz frequency in an alumina medium with a dielectric constant of 10. The transmit and receive antenna arrays are consequently equidistant from the first grid 18.

The assembly 33 is adjacent to a first waveguide 35 which is of larger dimensions than those appropriate at the operating frequency. The first waveguide 35 is connected to a second waveguide 36, the latter having dimensions correctly proportioned for the operating frequency of 16 GHz. The sensor 10 also incorporates a second alumina lens 40 which is concavo-convex, and a circular polarizer 42. The polarizer 42 is of the meander line, printed circuit variety described in "IEEE Transactions on Antennas and Propagation", Vol AP-35, No. 6, Jun. 1987, pages 652 to 661.

The first and second lenses 12 and 40 form in combination a doublet lens system or compound lens having two focal planes. One focal plane arises from reflection at the first grid 18 and transmission at the second grid 20. It is coincident with the receive array plane on the substrate surface 26*a*. The other focal plane is at 34 coincident with the transmit array plane, and arises from transmission through the first grid 18. The focal planes at 26*a* and 34 are parallel to the grid 18 and on opposite sides of it.

The sensor 10 operates as follows. Microwave input power at 16 GHz from a source (not shown) is fed along the second waveguide 36; it is polarized vertically in the plane of the drawing as indicated by an encircled arrow 44. The input power passes into the first waveguide 35, and, when the sensor 10 is switched off, through the transmit antenna array to the third grid where it undergoes reflection. When the transmit antenna array is activated as will be described later, it absorbs the power reflected from the third grid and re-radiates it with polarization rotated through 90°; ie. the transmit array acts as a polarization switch. This produces a transmit signal Tx, which has horizontal linear polarization perpendicular to the plane of the drawing as indicated by a circled cross 46.

The horizontally polarized transmit signal Tx passes from the transmit antenna array into the frusto-conical lens portion 16 as indicated by single arrows such as 48. It is transmitted through the first grid 18 since it is polarized orthogonally to the wires of that grid. Thereafter it passes through the spherical cap lens portion 14 to air, and then to the second lens 40. On leaving the second lens 40, the circular polarizer 42 converts the transmit signal Tx from linear horizontal polarization at 50 to circular polarization as indicated by a part circular arrow 52. The transmit signal Tx leaves the second lens 40 as a parallel beam, by virtue of the transmit array's location at a focal plane of the lens system 12/40.

The transmit signal Tx has a beam direction controlled by the transmit antenna array. A dotted line 54 indicates the optical axis of the lens doublet 12/40, this also being the symmetry axis of the lens portions 14 and 16. Activation of antennas at positions indicated by −15° and +15° below and above and the axis 54 give rise to transmit beams 56 and 58 directed at −15° and +15° to this axis respectively. A central beam direction is indicated by 60 at 0° on the lens system axis 54, this being the boresight of the sensor 10. The lens system 12/40 gives a field of view which is a 60° cone centered on the axis 54.

A transmit signal Tx which undergoes an odd number of reflections or "bounces" in a scene is returned as a receive signal indicated by Rx having relatively reversed polarization. An "odd bounce" receive signal Rx approaching the polarizer 42 at 62 consequently has the opposite hand of circular polarization compared to the outgoing transmit signal Tx at 52. The receive signal is converted to vertical linear polarization (in the plane of the drawing) by the polarizer 42 as indicated by a circled vertical arrow 64.

Receive signals Rx return along transmit beam paths as indicated by double arrows such as 66 until the first grid 18 is reached. Since the receive signals are polarized parallel to the first grid conductors, they are reflected towards the receive antenna array on the substrate 26. They are transmitted by the second grid 20 since they are polarized orthogonally to it. The second grid serves to reflect transmit radiation so that the receive antenna array is screened from direct receipt of high power from the transmit array. The receive array is located on the substrate surface 26a in a focal plane of the lens system 12/40, at which parallel receive radiation is focussed.

The receive antenna array obtains a further input from the microwave feed 28, this providing a local oscillator (LO) signal. The antenna array mixes the receive and local oscillator signals Rx and LO to produce intermediate frequency (IF) signals for subsequent signal processing in a known manner.

Figure 2:
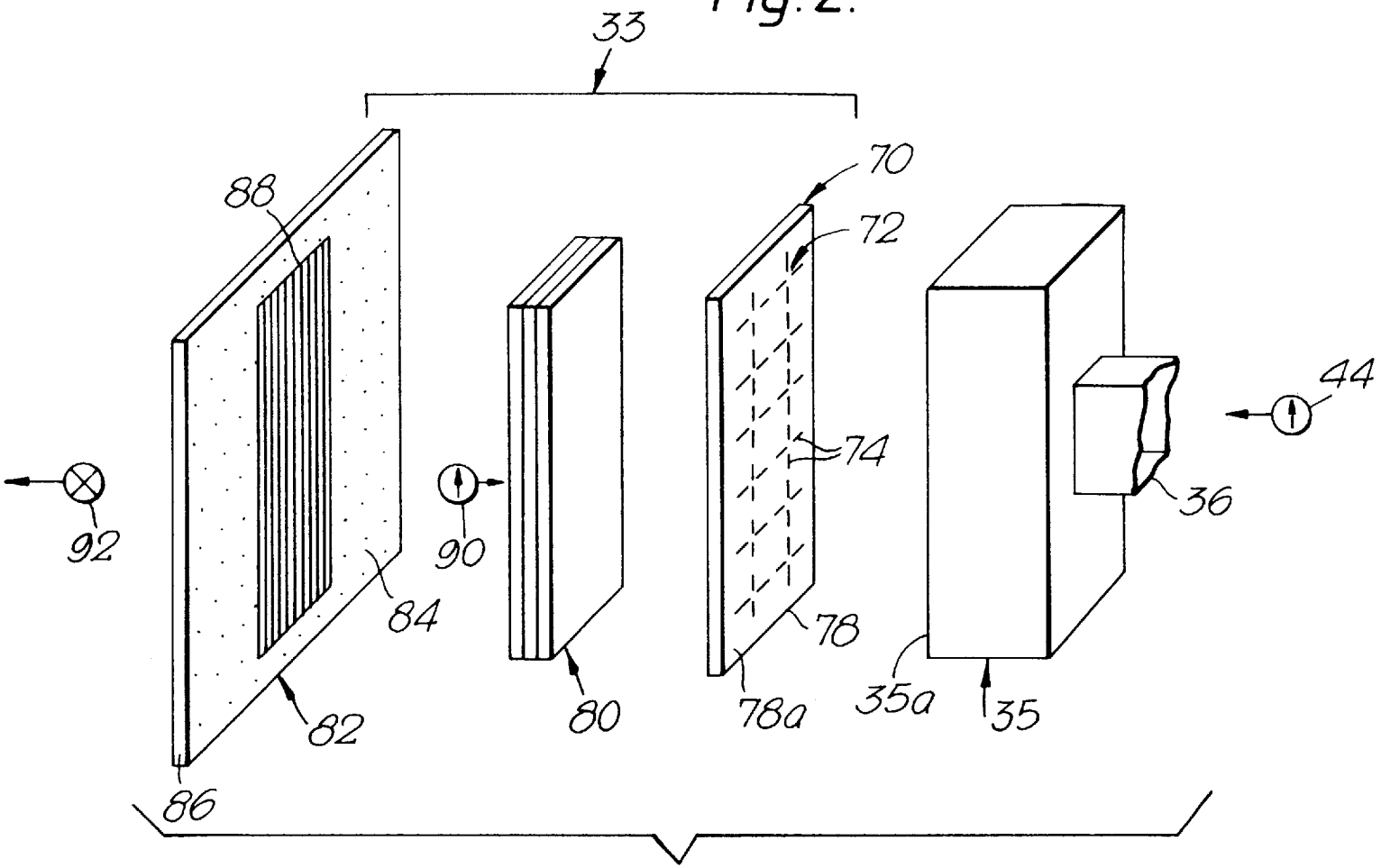
FIG. 2 is a disassembled view of a signal transmitting device for use in the FIG. 1 sensor.

Referring now also to FIG. 2, an exploded diagram of the assembly 33 and first and second waveguides 35 and 36 is shown. The transmit antenna array is indicated generally by 70. It incorporates twelve antennas such as 72 arranged in a 6×2 array. The antennas 72 are indicated schematically by crosses.

Each of the antennas 72 consists of a crossed pair of mutually orthogonal planar metal dipoles, each dipole having a pair of rectangular limbs such as 74. The form of the transmit antennas 72 is shown generally in FIG. 3. Each dipole is 4 mm in length, and limbs 74 are 1.43 mm in length with a central space 1.14 mm in length. Adjacent antennas 72 have a center-to-center spacing of 5.4 mm. The limbs 74 are 0.4 mm width, giving each dipole a length to width ratio of 10:1. This provides half wavelength dipole resonance at 16 GHz, since it can be shown that the effective length of each dipole is its physical length multiplied by the square root of the average of the dielectric constants of the two media on either side of it. Since the antennas 72 have air on one side ($\epsilon$=1) and alumina ($\epsilon$=10) on the other, their effective length is 4 mm multiplied by $\sqrt{[\frac{1}{2}(10+1)]}$. This is 9.38 mm, which is a half wavelength at 16 GHz.

Each dipole limb 74 is connected to a respective orthogonal dipole limb via a PIN diode switch 76 activatable by DC biasing. Bias connections to the diode switches 76 are not shown. The antennas 72 are formed by deposition of metal on to a surface 78*a* of a substrate 78. The substrate surface 78*a* is 35 mm×23 mm. The PIN diodes are discrete devices; ie hybrid electronic technology is employed. These diodes might alternatively be integrated with the antennas in semiconductor substrate material.

The transmit array 70 is separated by alumina spacers 80 from the third grid, which is indicated generally by 82. The latter is formed by deposition of a metal layer 84 (indicated by dots) on an alumina substrate 86. The layer 84 has a central region which is etched to define linear conductors such as 88 separated by spaces exposing the underlying alumina material. When arranged as the assembly 33, the spacers 80 are in contact with the grid 82, and the transmit array substrate 78 is in contact with the spacers 80. The oversize first waveguide 35 has an end rim 35*a* which in use is assembled against the substrate surface 78*a*. The underlying grid surface (not shown) is in contact with the lens end face 32.

The array substrate 78, the spacers 80 and the grid 82 are of alumina as has been said; their thicknesses are combined in the assembly 33 to locate the transmit array antennas 72 in the focal plane 34 of the lens system 12/40.

The spacing (5.4 mm) of the antennas 72 in the transmit array 70 is designed to provide for radiation beams of neighboring antennas to overlap at their 3 dB points. Each antenna 72 is at a respective position in the focal plane 34, and the displacement of its position from the system axis 54 produces a corresponding angular displacement of its output beam direction from that axis. In free space, the diffraction lobe width for an antenna dipole output focussed by a lens is approximately $1.2\lambda/D$, where $\lambda$ is the free space wavelength and D is the lens aperture. Overlap at 3 dB points consequently requires the antenna array spacing to be correct for a given wavelength and aperture. The appropriate spacing reduces with reducing $\lambda$.

The transmit antenna array 70 operates as follows. When all the PIN diodes 76 are switched off, very little of the vertically polarized input microwave power 44 is coupled to either dipole of each of the antennas 72. This is because of the antenna polar diagram. In consequence, the power passes through the array 70 and spacers 80 largely unaffected. It is reflected back by the third grid 82 as indiated at 90, since it is polarized parallel to the grid conductors 88. It is therefore prevented from reaching the lens 12 for subsequent output to free space.

When one pair of diodes 76 associated with any one of the antennas 72 is switched on, the microwave signal induced by the vertically polarized electrical field in that antenna's vertical dipole becomes coupled to its associated horizontal dipole. This occurs by virtue of the current path provide by each PIN diode 76 between orthogonal dipole limbs. Most of the energy received by the switched-on antenna 72 is coupled to its horizontal dipole. It is subsequently re-radiated with horizontal polarization. As disclosed by C. R. Brewitt-Taylor, D. J. Gunton and H. D. Rees in Electronics Letters Vol. 17, pages 729–731, 1981, an antenna located at an interface between two media with differing dielectric constants radiates predominantly into the medium having the higher dielectric constant. In consequence, re-radiation from one of the antennas 72 is predominantly into the alumina substrate 78, since these antennas are located at an interface between air ($\epsilon$=1) and alumina ($\epsilon$=10).

The re-radiated signal from the antenna array 70 passes through the spacers 80 to the grid 82. Since it is polarized horizontally and therefore orthogonally to the grid conductors 88, it passes through the grid 82 with very little reflection as indicated at 92. It then passes into the lens 12 to become the transmit signal Tx.

In operation, the direction and spatial extent of the transmit beam is determined by which of the transmit antennas 72 are activated. A re-radiated signal, which is horizontally polarized, originates at any antenna 72 which is activated. Since the antennas 72 are distributed over the lens system focal plane at 34, activation of a single antenna 72 will give rise to a transmit beam direction determined by the antenna location. If two or more antennas 72 are activated at the same time, power will be transmitted in two or more directions simultaneously. In FIG. 1, transmit beam directions are indicated which are inclined at ±15° to a central (boresight) beam direction at 0°.

Figure 4:
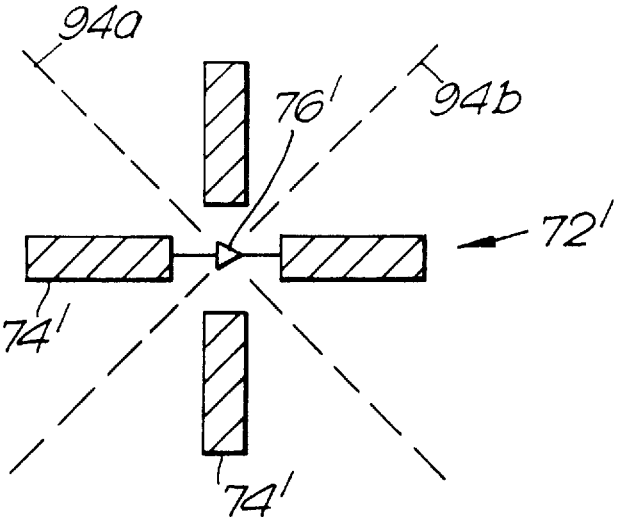

An alternative form of transmit antenna suitable for use in the array 70 is shown in FIG. 4. It is indicated generally by 72', and parts equivalent to those previously described are like-referenced with a prime superscript. It has limbs such as 74' one opposed pair of which are connected via a PIN diode switch 76'activated by DC biasing. It is suitable for switching the polarization of a microwave signal from parallelism to either one of two dotted lines 94*a* and 94*b* to parallelism to the other. When employed in the transmit array 70 in FIG. 2, the antenna 72' would have limbs 74' disposed diagonally instead of horizontally and vertically as shown for antennas 72.

Figure 5:
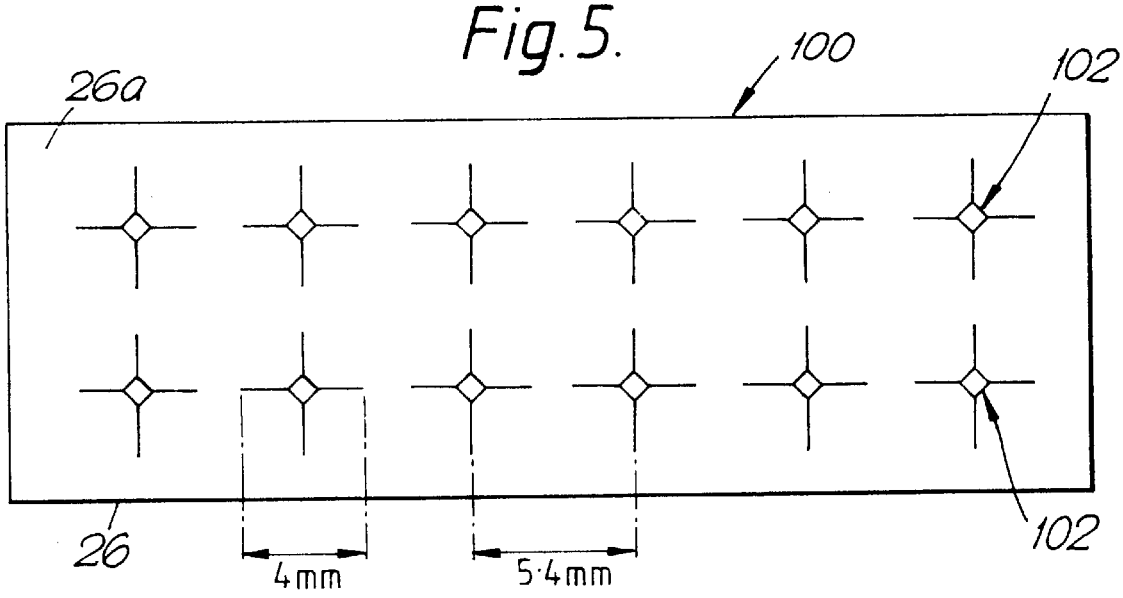
FIG. 5 schematically shows a receive antenna array incorporated in the FIG. 1 sensor.
Figure 6:
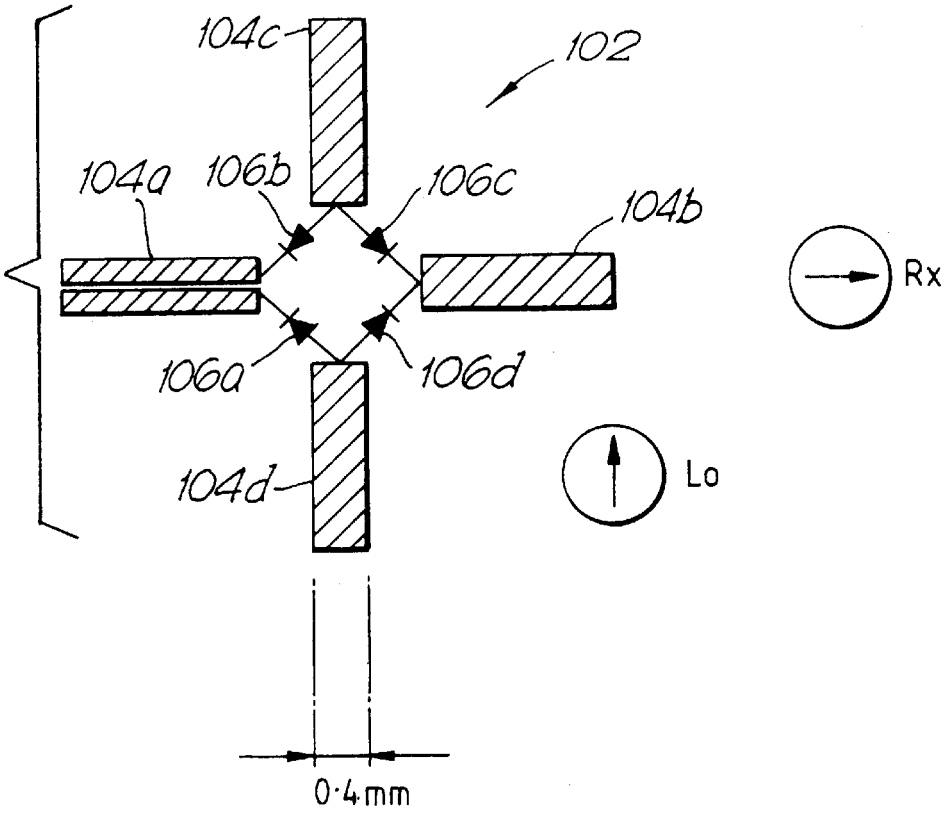
FIG. 6 is a plan view of a crossed dipole antenna of the FIG. 5 array.

Referring now to FIGS. 5 and 6, the receive antenna array is shown in more detail. It is indicated generally by 100 in FIG. 5, and incorporates individual antennas 102 in a 6×2 array and shown schematically as crosses. FIG. 5 is shown approximately five times actual size for 16 GHz operation. FIG. 6 shows an individual receive antenna 102 in more detail. The receive array 100 has antennas 102 with numbers, form and spacing like to those of the transmit array 70. The two arrays 70 and 100 are disposed with their planes and long dimensions parallel. The receive array 100 differs to the transmit array 70 in that each antenna 102 incorporates a limb 104*a* which is longitudinally divided.

In addition, each antenna 102 has a central ring of four radar frequency (RF) mixer diodes 106*a* to 106*d*. Each of the diodes 106*a* to 106*d* is connected between a respective pair of limbs 104 of different (orthogonal) dipoles, such as diode 106*c* between limbs 104*b* and 104*c*. The limbs 104*c* and 104*d* of one of the dipoles in FIG. 6 are connected to the anodes of diode pairs 106*b*/106*c* and 106*a*/106*d* respectively. The limbs 104*a* and 104*b* of the other dipole are connected to the anodes of the diode pairs 106*a*/106*b* and 106*c*/106*d* respectively. The diodes 106*a* to 106*d* are consequently polarized towards the limbs of one dipole and away from the limbs of the other. The divisions of the split limb 104*a* are connected to respective diodes 106*a* and 106*b*.

The receive array 100 operates as follows. Its long dimension is shown horizontal in FIGS. 5 and 6, but vertical in FIG. 1. Receive radiation Rx at the radar frequency (RF) of 16 GHz is polarized parallel to the split-limb dipole 104*a*/104*b*. Local oscillator (LO) radiation from the horn 28 (see FIG. 1) is polarized parallel to the other dipole 104*c*/104*d*. The LO and RF radiations develop signals in the dipoles to which their polarizations are parallel, and these signals are mixed by the ring of diodes 106*a* to 106*d* to produce intermediate frequency (IF) signals. The IF signals are at the difference frequency between the LO and RF signals. The split limb 104*a* appears as a single limb at RF by virtue of capacitative coupling between its limbs. At IF however, it acts as two parallel conductors forming a transmission line. It consequently provides an output feed for relaying IF signals to processing circuitry (not shown). Such circuitry is well known in the art of radar signal processing and will not be described in detail. It may incorporate an IF amplifier and an analogue to digital converter (ADC) for each antenna 102. ADC output signals from the array 100 are fed to digital circuits of known kind.

The radar sensor 10 provides both transmit and receive capability within a common aperture defined by the optical aperture of the doublet lens system 12/40. The transmit and receive arrays 70 and 100 are mounted on substrates 78 and 26 which are of the same material as the lens 12 and act as extensions of it. Radiation reflections at surfaces of the doublet lens system 12/40 due to boundaries between dissimilar dielectric media are suppressed by anti-reflection coatings similar to lens blooming in cameras and the like.

Figure 7:
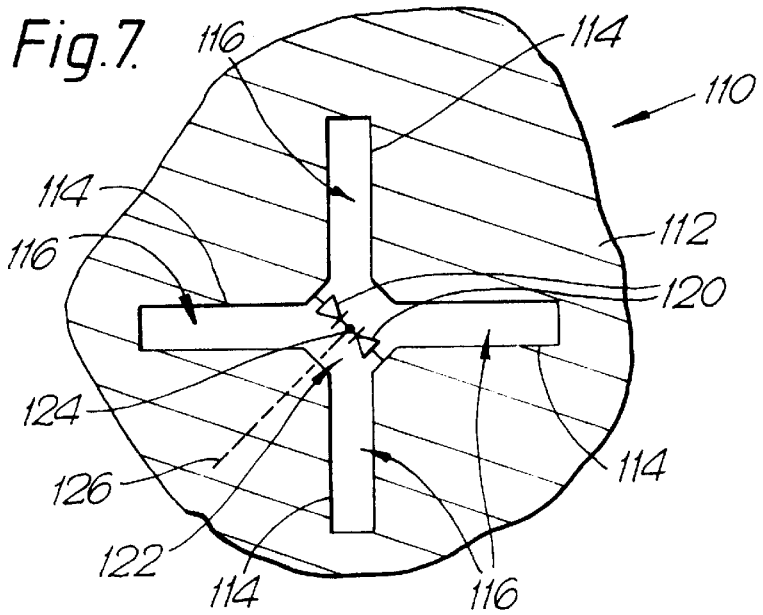
FIG. 7 shows an alternative form of polarization-switching antenna for the FIG. 2 device.

Referring now to FIG. 7, an alternative form of polarization switching transmit antenna is shown, this being indicated generally by 110. The antenna 110 consists of a metallization layer 112 in which orthogonal crossed slots 114 are formed exposing an underlying substrate 116. A pair of PIN diode switches 120 are connected in series with mutually opposed polarities (cathode to cathode) across a central common space 122 of the slots 114. The switches 120 are connected diagonally across the space 122, and have a central common point 124 to which a DC bias voltage is fed via a lead indicated by a dotted line 126.

Figure 3:
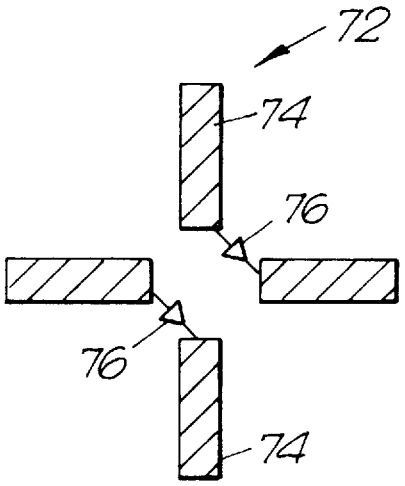
FIGS. 3 and 4 schematically illustrate polarization-switching antennas for use in the FIG. 2 device.

The antenna 110 operates as described for the antenna 72 of FIG. 3. The antenna 110 does however have the advantage of superior heat sinking of the switches 120 via the metallization layer 112. This allows the switches to control a higher RF power level. The presence of the layer 112 everywhere except at switch sites inhibits escape of RF power from between switch sites. Moreover, the layer 112 permits semiconductor components and bond wires to be located close to the slots 114 without degrading their performance.

Figure 8:
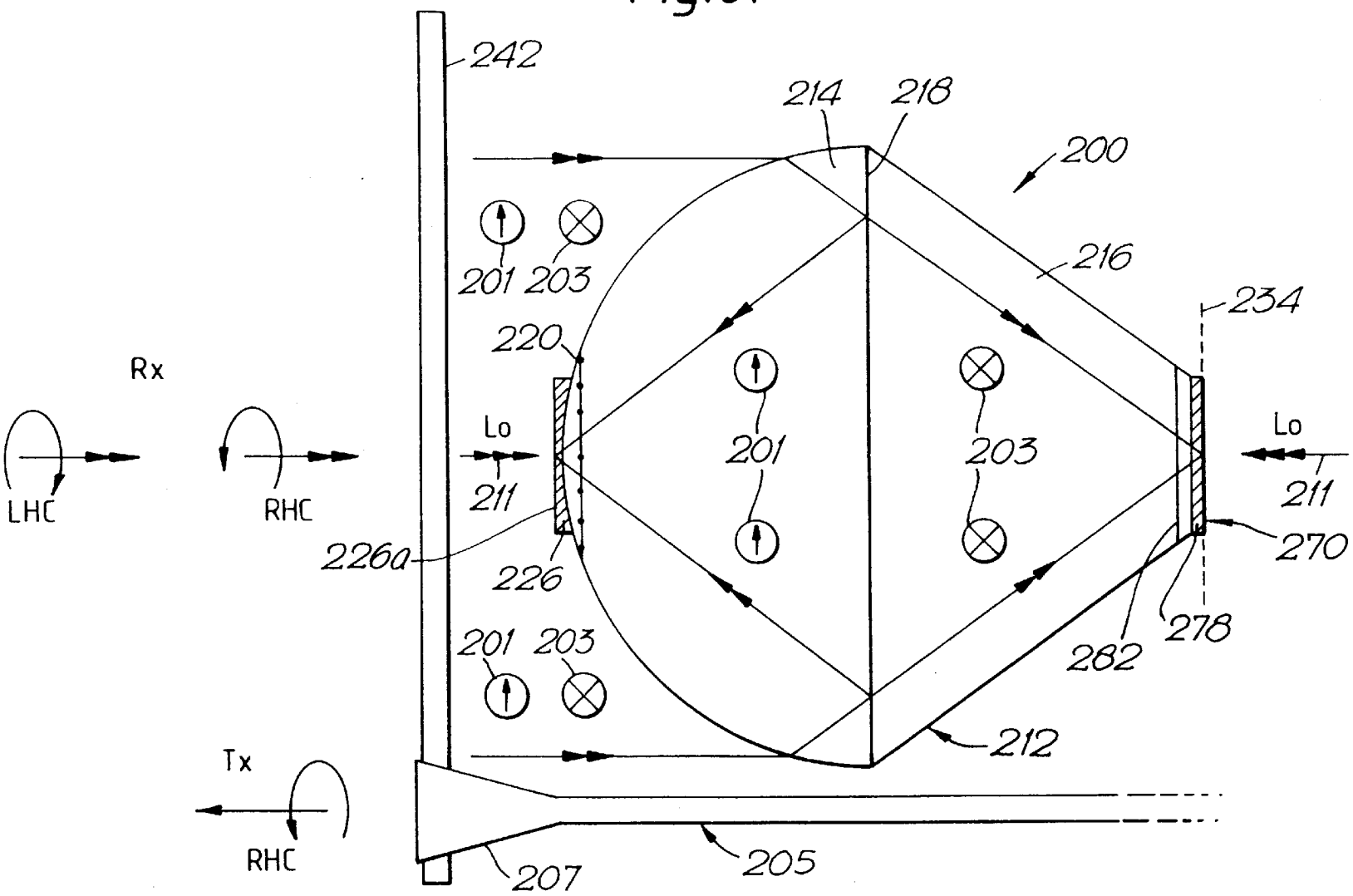
FIG. 8 is a schematic sectional side view of an alternative form of sensor of the invention incorporating two receive antenna arrays.

Referring now to FIG. 8, there is shown a sectional side view of an alternative embodiment of a radiation sensor of the invention indicated generally by 200. It has a number of similarities to the sensor 10 of FIG. 1, and parts equivalent to those described earlier are like-referenced with a 200 prefix. In view of these similarities, it will be described in outline only. The sensor 200 incorporates a lens 212 with a spherical cap portion 214 and a frusto-conical portion 216. The lens 212 has a central grid 218 which defines reflection and transmission focal planes at 226a and 234 respectively. These planes are on the outer surfaces of substrates 226 and 278, each of which bears a respective receive antenna array (not shown). The lens portions 214 and 216 incorporate grids 220 and 282 which transmit vertically and horizontally polarized signals 201/203 respectively.

The sensor 200 also incorporates a transmitter antenna 205 having an output horn 207 extending through a circular polarizer 242. The antenna 205 generates a right hand circularly polarized (RHC) transmit signal Tx, which passes to a remote scene (not shown). Returns from the scene are either RHC or left hand circularly polarized (LHC) according respectively to whether they arise from Tx signals which have undergone even or odd numbers of reflections.

The RHC Rx signals are converted by the polarizer 242 to vertical polarization 201, and are focussed by the lens 212 at the receive array 226*a* after reflection at the grid 218. The LHC Rx signals are converted to horizontal polarization 203 by the polarizer 242. This polarization is transmitted by the grid 218 and focussed by the lens 212 at the other focal plane 234. Rx signals reaching the focal planes 234 and 226*a* are detected and processed by respective receive antenna arrays each as described with reference to FIGS. 5 and 6. LO signals are fed to the receive arrays as indicated by arrows 211.

The sensor 200 employs an adapted version of the dual focal plane approach of FIG. 1 to define two receive locations instead of transmit and receive locations. It loses the capability of steering the transmit beam Tx by polarization switching in a focal plane antenna array. Instead, the transmit beam Tx from the horn 205 is employed to provide a floodlight beam illuminating a scene. It cannot be steered to follow a moving target or to direct microwave energy in a preferred direction. Against this, it has the capability of distinguishing targets on the basis of their reflection characteristics.

The sensor 200 may be operated without the transmit horn 205. It would act as a passive sensor detecting signals generated in a scene.

The embodiment of FIG. 1 employed antenna arrays mounted on substrates 26 etc of the same material as the lens 12 and acting as extensions of it; ie radiation reached or left the relevant antenna array such as 100 via the substrate thickness. It is also possible to employ substrates of silicon or GaAs on which semiconductor diodes and antennas are integrated. The dielectric constant of silicon is 11.7 and that of GaAs is 12.5. These are both close to that of alumina and reflections at lens/substrate interfaces will be insignificant. Radiation may therefore reach the array via the substrate as before.

Each antenna array such as 100 may alternatively be located between its substrate 26 and the lens 12. In this case the arrangement must be such that the antennas couple predominantly to radiation passing through the lens (in receive or transmit as appropriate). This can be satisfied if the lens dielectric constant is higher than that of the substrate, or if the substrate is very much thinner than the radiation wavelength in its material.

The receive and transmit antennas 102/74 in the arrays 100/70 are located accurately in respective focal planes 26*a*/34 of the lens 12. This ensures that each antenna corresponds to a respective receive or transmit beam direction in free space through the lens. Signal processing of IF signals to isolate contributions from different directions is unnecessary.

It is possible to locate the transmit array 70 and the receive array 100 at positions slightly displaced from respective focal planes 34 and 26*a*. This displacement is in each case by a distance which is less than or equal to one wavelength of radiation in the lens or substrate material immediately adjacent the relevant antenna array 70 or 100 at the operating frequency. In the device 10 of FIG. 1 designed for operation at 16 GHz, the maximum displacement is the corresponding free space wavelength of 1.89 cm divided by the square root of the dielectric constant of alumina ($\epsilon$=10), which is 0.59 cm. In the receive mode, such a displacement of the receive array 100 means that radiation from a single direction in free space couples to more than one antenna 102. However, the IF signals derived from a few neighboring antennas 102 in the receive array 100 can be combined with appropriate weighting coefficients to give a signal corresponding to an incident plane wave. The weighting coefficients would depend on the chosen incident direction. Similarly, in the transmit mode, a transmit array may be displaced from the focal plane 34 towards the first grid 18. In this case, several transmit antennas 72 would be activated simultaneously to generate a combined beam arising from interference between individual antenna contributions. As will be described later in more detail, appropriately switchable transmit antennas provide a degree of phase control sufficient for crude beamforming. It is important to distinguish this off-focal-plane approach from a conventional aperture-plane phased array, which requires phase and amplitude control over hundreds or even thousands of radiating elements.

Both the embodiments of FIGS. 1 and 8 employ a polarization selective reflector grid 18/218 to define focal planes 26*a*/226*a* and 34/234. The grids 18/218 are parallel to and located between the focal planes they define. This leads to a very compact arrangement with rotational symmetry about the optical axis 54 in FIG. 1 for example. If the grid 18 is tilted slightly out of the perpendicular to the axis 54, the device 10 would still be realizable with relocated focal planes, but symmetry and compactness would be reduced.

It is an advantage that the sensors of FIGS. 1 and 8 can be realized with lenses 12/212 made of synthetic plastics-based material with a dielectric constant of 10. Polymer/ceramic based artificial dielectric materials are moldable, inexpensive, relatively straightforward to machine, and not unacceptably dense. It is not necessary to employ high dielectric constant materials, which tend to be expensive, difficult to machine and to yield heavy components.

In an alternative embodiment of the invention (not shown), the transmit assembly 33 shown in FIGS. 1 and 2 is replaced by a microwave signal source which is mechanically (rather than electronically) relocatable. This embodiment employs a flexible coaxial signal feed to a section of waveguide providing power to a single, permanently short-circuited polarization switching antenna. The antenna is located in the lens focal plane 24 and radiates microwave power into the lens 12. The section of waveguide is movable along two mutually orthogonal axes in the focal plane 34 by stepper motors. This provides for the location of the transmit signal origin in the focal plane 34 to be appropriate to any one of a number of transmit beam directions.

Figure 9A:
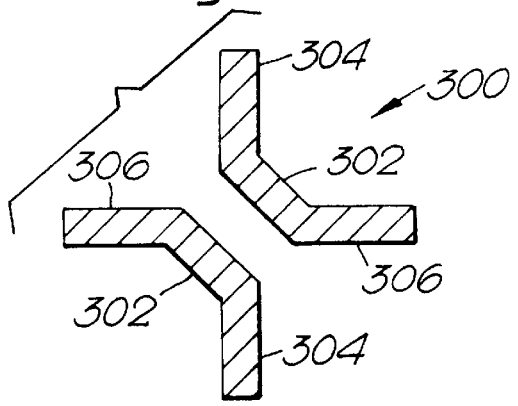
FIG. 9 illustrates polarization-switching antennas arranged to provide phase control.
Figure 9B:
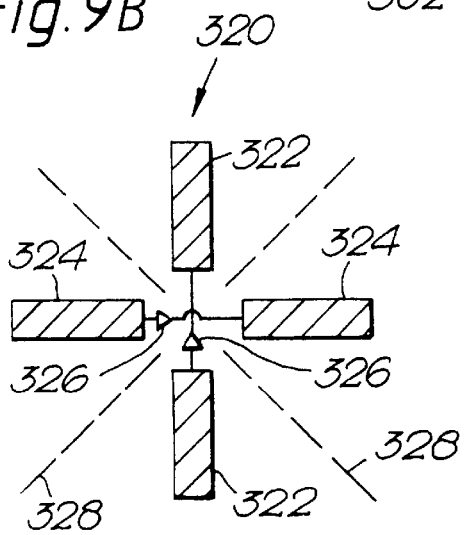
Figure 9C:
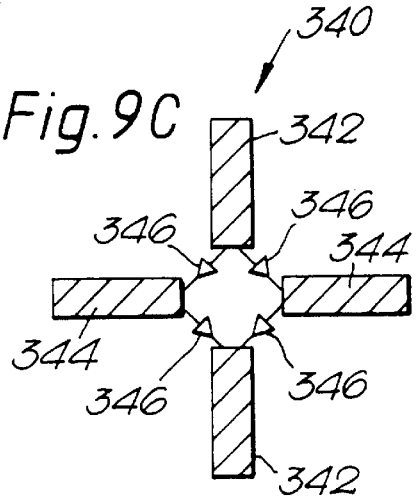

Referring now to FIG. 9, there are shown three alternative forms of crossed-dipole transmit antenna referenced 300, 320 and 340 respectively. The first of these, the antenna 300, is equivalent to that shown in FIG. 3 with PIN diodes 76 replaced by short-circuiting bars 302 connecting each dipole limb 304 to a respective orthogonal limb 306. It provides the permanently polarization switching antenna referred to in the previous paragraph. It converts an unfocussed input from a waveguide (equivalent to waveguide 35) to a localized source in or near a lens focal plane. It can be thought of as floodlight to spot converter, and can transmit a much higher power level than a diode-switched antenna.

The antenna 320 is similar to that shown in FIG. 4, except that both pairs of antenna limbs 322/324 are connected by respective PIN switching diodes 326 which are insulated from each other. Either one diode or the other is switched on to change the polarization from parallelism to one dotted line 328 to parallelism to the other, as in the FIG. 4 embodiment. However, the transmit signal phase differs by 180° between the two cases; ie switching on one diode 326 provides an output which is antiphase to that produced by switching on the other. This provides coarse phase control suitable for a transmit array of antennas 320 located within one wavelength of and arranged parallel to the focal plane 34.

The antenna 340 is equivalent to that shown in FIG. 3, except that each antenna limb 342/344 is connected to both orthogonal limbs 344/342 by respective PIN diode switches 346. Like the antenna 320, the antenna 340 is suitable for replication to form a polarization switching transmit array. The diodes 346 are switched on in diametrically opposed pairs. In either case, polarization is switched through 90°, but the phase of the signal produced by switching on one pair differs by 180° to that produced by switching on the other pair.

We claim:

1. A radiation sensor including a converging dielectric lens arranged to define an optical aperture and an optical axis through the aperture, and wherein:

(a) the lens incorporates polarization-selective reflecting means for defining first and second focal planes at respective lens surface regions extending across the optical axis, (b) the reflecting means provides for the focal planes to correspond to differing radiation polarization, (c) a first receive array of antennas is located not more than $\lambda_1$ from the first focal plane, where $\lambda_1$ is an operating wavelength of the sensor measured in a medium adjacent the first focal plane and through which radiation passes to the receive array, each antenna defining a respective radiation beam direction through the lens and being coupled predominantly to radiation passing through the lens, and (d) directionally selective transmitting means couplable to a plurality of output beam directions through the lens are located not more than $\lambda_2$ from the second focal plane, where $\lambda_2$ is an operating wavelength of the sensor as measured in a medium adjacent the second focal plane through which radiation Passes from the transmitting means.

2. A sensor according to claim 1 wherein the reflecting means is a grid of linear conductors sandwiched between two lens portions and extending parallel to both focal planes.

3. A sensor according to claim 1 wherein the said two lens portions have spherical cap and frusto-conical shapes respectively.

4. A sensor according to claim 1 wherein the reflecting means is arranged to direct linearly polarized receive radiation to the first focal plane array, this array is two dimensional and comprises antennas each in the form of a pair of crossed dipoles, one dipole of each pair is parallel to receive radiation polarization incident on it, and the sensor includes means for directing a local oscillator signal to this array polarized parallel to the other dipole of each pair.

5. A sensor according to claim 4 wherein each antenna includes a ring of mixer diodes arranged to mix receive radiation signals and local oscillator signals developed in respective dipoles and to produce intermediate frequency signals.

6. A sensor according to claim 5 wherein each antenna includes a divided dipole limb acting as an intermediate frequency transmission line.

7. A sensor according to claim 1 wherein said directionally selective transmitting means comprises an array of separately activatable polarization switching antennas, a linearly polarized signal feed to these antennas, and polarization-selective reflecting means arranged to isolate the signal feed from output through the lens and to transmit to the lens polarization-switched signals developed in any of these antennas in response to the signal feed.

8. A sensor according to claim 7 wherein the polarization-switching antennas are crossed-dipole slots in a metal sheet and are activatable by diagonally connected switching means.

9. A sensor according to claim 1 including directionally selective transmitting means comprising a signal feed incorporating a non-switchable polarization-rotating antenna, and means for moving this antenna across the second focal plane.

10. A radiation sensor including a converging dielectric lens arranged to define an optical aperture and an optical axis through the aperture, and wherein:

(a) the lens incorporates polarization-selective reflecting means for defining first and second focal planes at respective lens surface regions extending across the optical axis, (b) the reflecting means provides for the focal planes to correspond to differing radiation polarization, (c) a first receive array of antennas is located not more than $\lambda_1$ from the first focal plane, where $\lambda_1$ is an operating wavelength of the sensor measured in a medium adjacent the first focal plane and through which radiation passes to the receive array, each antenna defining a respective radiation beam direction through the lens and being coupled predominantly to radiation passing through the lens, and (d) a second receive array of antennas is arranged equivalently to the first receive array to respond to a different radiation polarization, the second receive array being located not more than $\lambda_2$ from the second focal plane, where $\lambda_2$ is an operating wavelength of the sensor measured in a medium adjacent the second focal plane and through which radiation passes to the second receive array.

11. A sensor according to claim 10 wherein said second receive array is of like construction to said first receive array.

12. A sensor according to claim 11 including transmitting means for providing microwave illumination of a scene externally of the lens aperture.

13. A sensor according to claim 10 wherein the reflecting means is a grid of linear conductors sandwiched between two lens portions and extending parallel to both focal planes.

14. A sensor according to claim 10 wherein the said two lens portions have spherical cap and frusto-conical shapes respectively.

15. A sensor according to claim 10 wherein the reflecting means is arranged to direct linearly polarized receive radiation to the first focal plane array, this array is two dimensional and comprises antennas each in the form of a pair of crossed dipoles, one dipole of each pair is parallel to receive radiation polarization incident on it, and the sensor includes means for directing a local oscillator signal to this array polarized parallel to the other dipole of each pair.

16. A sensor according to claim 15 wherein each antenna includes a ring of mixer diodes arranged to mix receive radiation signals and local oscillator signals developed in respective dipoles and to produce intermediate frequency signals.

17. A sensor according to claim 16 wherein each antenna includes a divided dipole limb acting as an intermediate frequency transmission line.

18. A sensor according to claim 10 wherein said directionally selective transmitting means comprises an array of separately activatable polarization switching antennas, a linearly polarized signal feed to these antennas, and polarization-selective reflecting means arranged to isolate the signal feed from output through the lens and to transmit to the lens polarization-switched signals developed in any of these antennas in response to the signal feed.

19. A sensor according to claim 18 wherein the polarization-switching antennas are crossed-dipole slots in a metal sheet and are activatable by diagonally connected switching means.

20. A sensor according to claim 10 including directionally selective transmitting means comprising a signal feed incorporating a non-switchable polarization-rotating antenna, and means for moving this antenna across the second focal plane.

* * * * *